US009906854B2

(12) United States Patent
Luo

(10) Patent No.: US 9,906,854 B2
(45) Date of Patent: Feb. 27, 2018

(54) WEARABLE DEVICE AND EARPHONE COMPONENT THEREOF

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventor: Shu-Wei Luo, Zhengzhou (CN)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/136,737

(22) Filed: Apr. 22, 2016

(65) Prior Publication Data

US 2017/0272854 A1 Sep. 21, 2017

(30) Foreign Application Priority Data

Mar. 21, 2016 (CN) ..... 2016 1 0156174

(51) Int. Cl.
*H04R 1/10* (2006.01)

(52) U.S. Cl.
CPC ..... *H04R 1/1075* (2013.01); *H04R 1/105* (2013.01); *H04R 1/1033* (2013.01); *H04R 1/1066* (2013.01)

(58) Field of Classification Search
CPC .... H04R 1/1075; H04R 1/1033; H04R 1/105; H04R 1/1058; H04R 1/1066; H04R 25/556; H04R 2420/09; H01R 13/6608; H01R 13/6658; H01R 13/6594; H01R 13/6595; H05K 3/301; H05K 2201/10606; G06F 1/183
See application file for complete search history.

(56) References Cited

U.S. PATENT DOCUMENTS

| | | | | |
|---|---|---|---|---|
| 5,528,460 | A * | 6/1996 | Byrd | H05K 3/301 307/150 |
| 8,517,744 | B2 * | 8/2013 | Lin | H01R 12/52 439/533 |
| 9,748,694 | B2 * | 8/2017 | Nonen | H01R 13/6273 |
| 2005/0286717 | A1 * | 12/2005 | Viduya | H04M 1/05 379/430 |
| 2009/0120682 | A1 * | 5/2009 | Ohtsuji | H01R 13/648 174/359 |
| 2009/0233487 | A1 * | 9/2009 | Zhou | H01R 13/562 439/626 |
| 2011/0007929 | A1 * | 1/2011 | Rabu | H04R 1/1033 381/380 |

* cited by examiner

*Primary Examiner* — Fan Tsang
*Assistant Examiner* — Angelica M McKinney
(74) *Attorney, Agent, or Firm* — ScienBiziP, P.C.

(57) ABSTRACT

The mode of attachment of a wearable device to an earphone component enables a durable connection between the two. The earphone component includes an earphone cable, a motherboard, and a support shelf, and the earphone cable is fastened to the motherboard by the support shelf.

12 Claims, 3 Drawing Sheets

WEARABLE DEVICE AND EARPHONE COMPONENT THEREOF

CROSS-REFERENCE TO RELATED APPLICATIONS

This application claims priority to Chinese Patent Application No. 201610156174.6 filed on Mar. 21, 2016, the contents of which are incorporated by reference herein.

FIELD

The subject matter herein generally relates to wearable devices, and more particularly to a wearable device with an earphone component.

BACKGROUND

Wearable devices, such as smart watches, smart glasses are popular because users can use them to listen to music, watch videos, or make calls. An earphone usually includes jack earphone or wireless earphone. However, the large size of the jack earphone affects appearance of a wearable device to which it is connected, and sound qualities of the wireless earphone can be poor.

BRIEF DESCRIPTION OF THE DRAWINGS

Implementations of the present technology will now be described, by way of example only, with reference to the attached figures, wherein.

DETAILED DESCRIPTION

Figure 1:
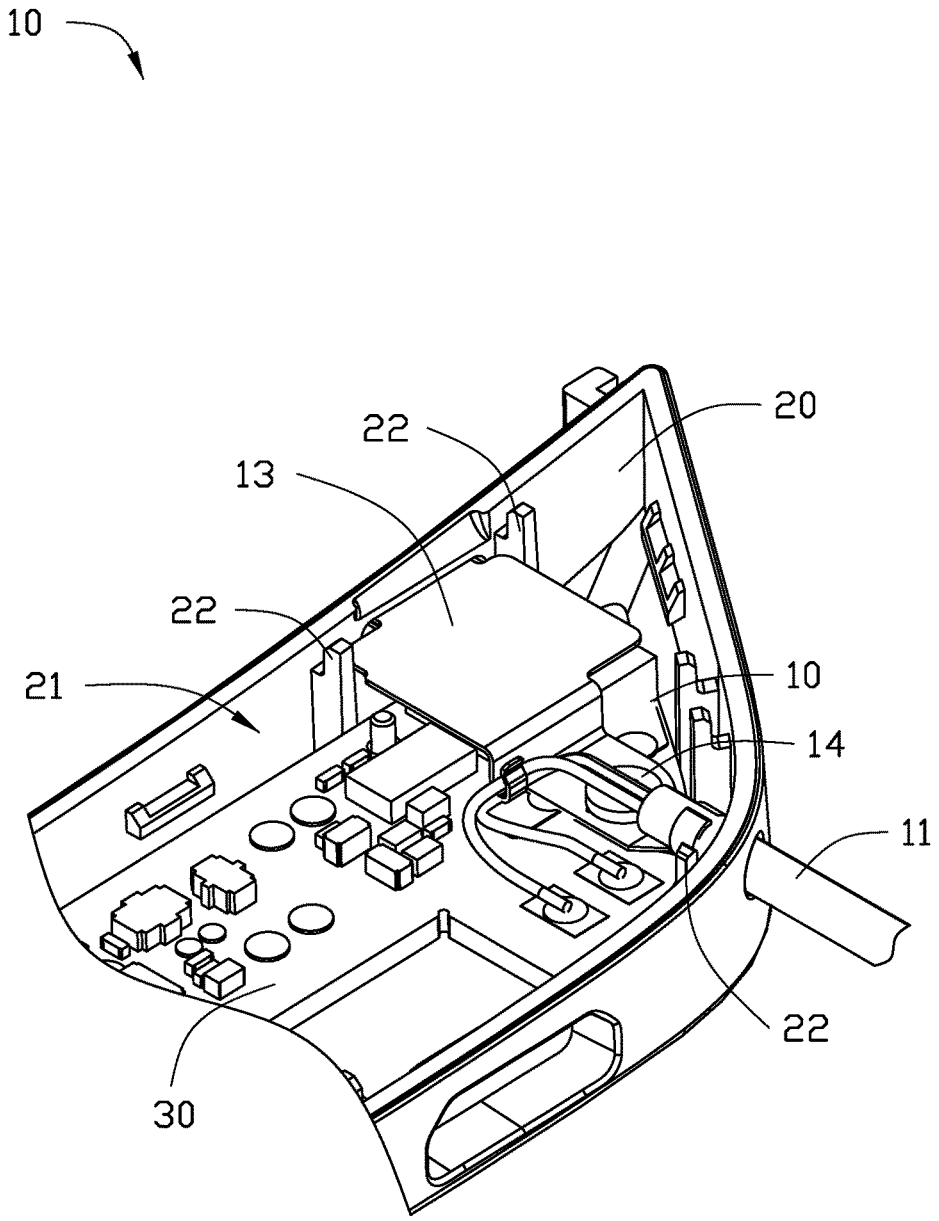
FIG. 1 is a diagrammatic view of one embodiment of a part of a wearable device with an earphone component.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The present disclosure, including the accompanying drawings, is illustrated by way of examples and not by way of limitation. Several definitions that apply throughout this disclosure will now be presented. It should be noted that references to "an" or "one" embodiment in this disclosure are not necessarily to the same embodiment, and such references mean "at least one."

Furthermore, the term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a gap on of a region is partially contained within a boundary formed by the object. The term "substantially" is defined to be essentially conforming to the particular dimension, shape or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a wearable device with an earphone component.

FIG. 1 illustrates one embodiment of a part of a wearable device with an earphone component. The wearable device 1 includes an earphone component 10, a motherboard 30, and a case 20. The case 20 defines a receiving space 21. The earphone component 10 and the motherboard 30 are received in the receiving space 21. The earphone component 10 includes an earphone cable 11 and a support shelf 13 and the earphone cable 11 is fixed to the motherboard 30 by the support shelf 13. In at least one embodiment, the wearable device 1 is a pair of smart glasses, a smart wristband, a smart watch, or the like.

Figure 2:
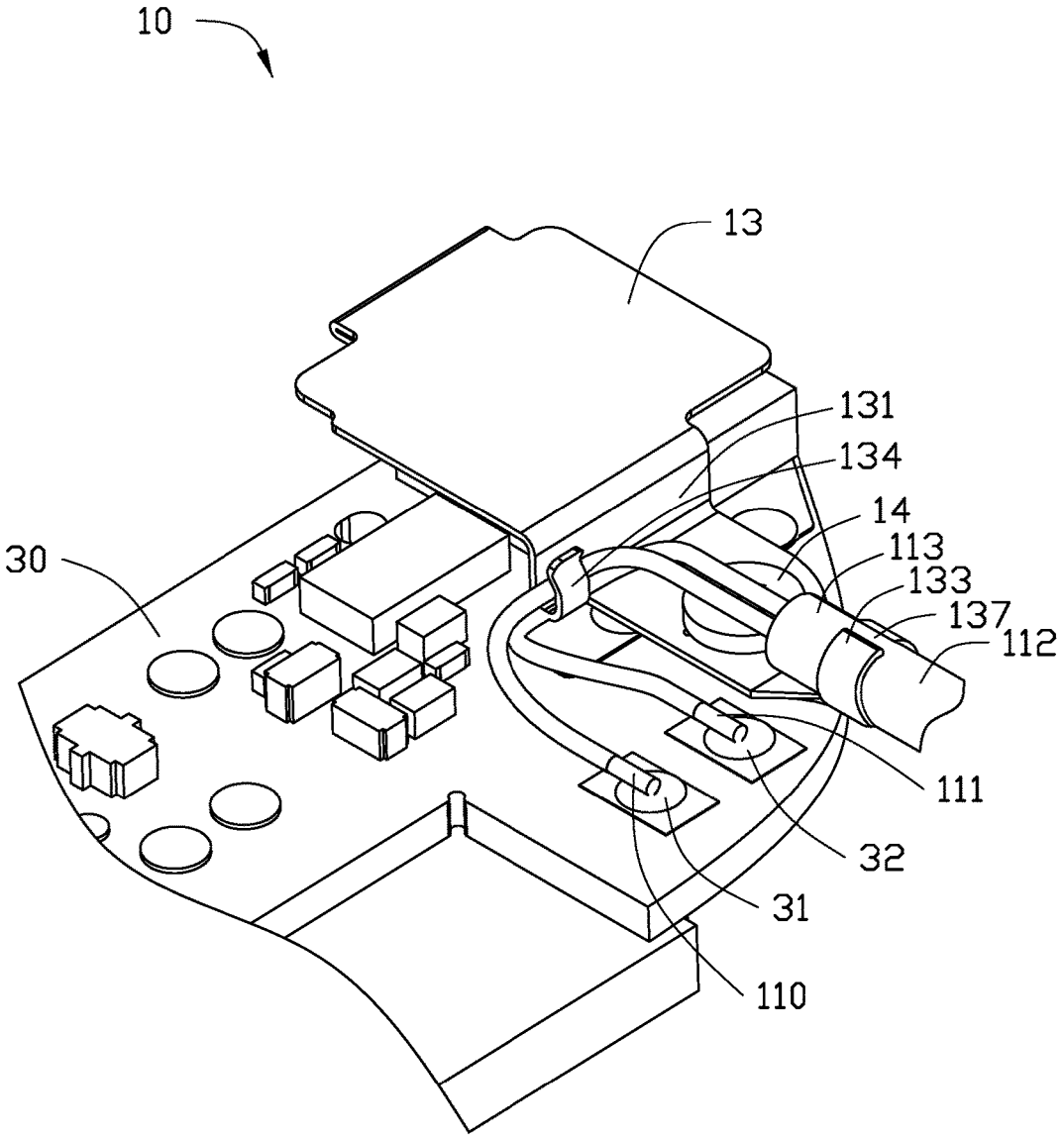
FIG. 2 is a diagrammatic view of the earphone component of FIG. 1

FIG. 2 illustrates the earphone component 10. A free end of the earphone cable 11 can be connected to an earplug(s) or an earplug jack (not shown). An earphone jack provides the user with the option to select among various aftermarket earphone options.

The earphone cable 11 includes a positive wire 110 and a negative wire 111, and an outer cover or coating coat 112 (hereinafter referred as coat 112). The positive wire 110 and the negative wire 111 are wrapped by the coat 112. Free ends of the positive wire 110 and the negative wire 111 are extended and exposed out of a free end of the coat 112, and further fixed to the motherboard 30. The motherboard 30 includes a positive head 31 and a negative head 32. The positive wire 110 is electrically connected to the positive head 31, and the negative wire 111 is electrically connected to the negative head 32.

In at least one embodiment (see FIGS. 2 and 3) the support shelf 13 is substantially step-shaped. The support shelf 13 includes a first sheet 130, a second sheet 131, and a third sheet 132. The first sheet 130 is parallel with the third sheet 132 and the second sheet 131 is perpendicularly arranged between the first sheet 130 and the third sheet 132.

The support shelf 13 further includes a collar or fastening element 133 (hereinafter fastening element 133). The fastening element 133 fastens the earphone cable 11 to the motherboard 30. The fastening element 133 is formed at a free end 1301 of the first sheet 130. In at least one embodiment, the fastening element 133 is ring-shaped.

In the illustrated embodiment, the fastening element 133 can fasten the free end of the earphone cable 11. The cable 11 is cylindrical. The fastening element 133 also defines a gap 137. In order to fix the cable 11, a first force is applied to the fastening element 133 to spread the gap 137, then the cable 11 is received in the fastening element 133. After that, a second force is applied to the fastening element 133 to close up the gap 137. Thereby, the fastening element 133 fixes and secures the cable 11.

As shown in FIG. 2, the second sheet 131 of the support shelf 13 includes a hook 134. In the embodiment, the hook 134 is U-shaped. The positive wire 110 and the negative wire 111 of the earphone cable 11 pass through the hook 134 to be fastened to the motherboard 30. In the illustrated embodiment, the hook 134 can further fix and secure the positive wire 110 and the negative wire 111 of the earphone cable 11, thus preventing the positive wire 110 and the negative wire 111 from moving and being damaged.

Figure 3:
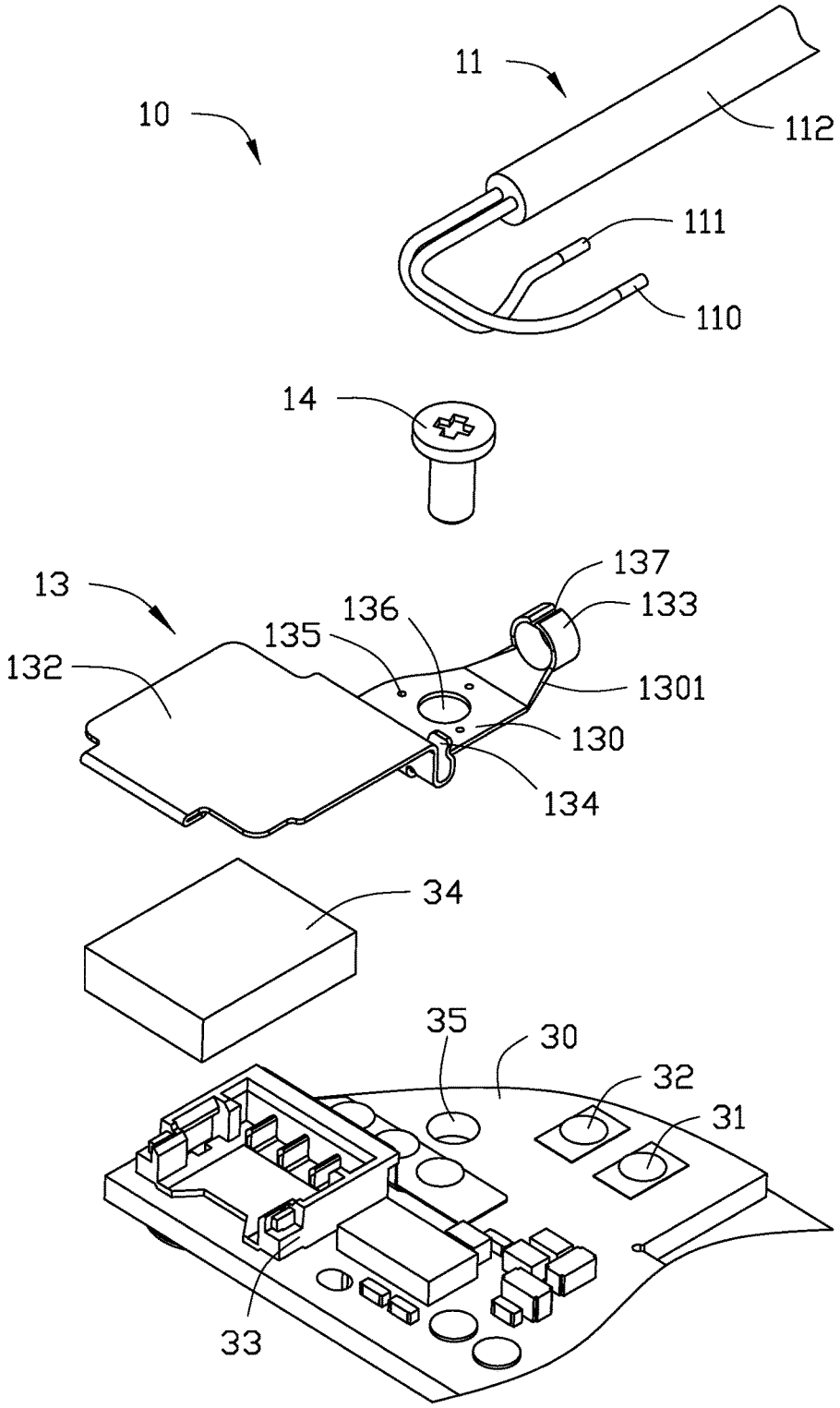
FIG. 3 is an exploded, isometric view of the earphone component of FIG. 2.

As shown in FIG. 3, the first sheet 130 of the support shelf 13 includes a number of negative elements 135. The negative elements 135 can connect to ground for discharging static electricity generated by the wearable devices 1. In at least one embodiment, the first sheet 130 includes three negative elements 135.

The motherboard 30 also includes a receiving chamber 33 for receiving a battery 34. The battery 34 supplies electrical power for the wearable device 1. In at least one embodiment, the battery 34 is a lithium battery. The third sheet 132 of the support shelf 13 can cover the battery 34. Thereby, the battery 34 is fixedly received in the receiving chamber 33.

The first sheet 130 of the support shelf 13 defines a through hole 136. The motherboard 30 defines a screw hole 35. The screw hole 35 corresponds to the through hole 136. The support shelf 13 is fastened to the motherboard 30 by a screw 14 passing through the through hole 136 to be received in the screw hole 35.

As shown in FIG. 1, the case 20 of the wearable device 1 defines a number of positioning elements 22 for positioning the support shelf 13 to prevent incorrect placement of the support shelf 13. In at least one embodiment, the case 20 includes three positioning elements 22.

The earphone cable of the earphone component 10 is directed fixed to the motherboard 30 of the wearable device 1 by the support shelf. Thereby, a jack structure is no longer needed, which not only makes the earphone component 10 can be tightly fixed to the wearable device 1, but also saves space of the wearable device 1.

The embodiments shown and described above are only examples. Many details are often found in the art such as the other features of a wearable device 1. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An earphone component of a wearable device, comprising:

an earphone cable; and a support shelf, wherein the earphone cable is fixed to a motherboard of the wearable device by the support shelf, wherein the support shelf is substantially step-shaped, and comprises a first sheet, a second sheet, and a third sheet, the first sheet is parallel with the third sheet, and the second sheet is perpendicularly arranged between the first sheet and the third sheet, wherein the first sheet comprises a plurality of negative elements for connecting to ground to discharge static electricity generated by the wearable device; and wherein the support shelf comprises a ring-shaped for fastening the earphone cable to the motherboard, the ring-shaped is formed at a free end of the first sheet.

2. The earphone component according to claim 1, wherein the earphone cable comprises a positive wire and a negative wire, the positive wire and the negative wire are fastened to the motherboard.

3. The earphone component according to claim 2, wherein the positive wire is electrically connected to a positive head of the motherboard, and the negative wire is electrically connected to a negative head of the motherboard.

4. The earphone component according to claim 2, wherein the second sheet comprises a hook, the positive wire and the negative wire pass through the hook to be fastened to the motherboard.

5. The earphone component according to claim 1, wherein, the third sheet covers a receiving chamber of the motherboard which receives a battery, so to enable the battery fixedly received in the receiving chamber.

6. The earphone component according to claim 1, wherein the first sheet defines a through hole, the support shelf is to be fastened to the motherboard when a screw passes through the through hole and is received in a screw hole of the motherboard which corresponds to the through hole.

7. A wearable device comprising:

a case defining a receiving space;

a motherboard received in the receiving space; and an earphone component received in the receiving space, the earphone component comprising:

an earphone cable; and a support shelf, wherein the earphone cable is fixed to the motherboard by the support shelf, the support shelf is substantially step-shaped, and comprises a first sheet, a second sheet, and a third sheet, the first sheet is parallel with the third sheet, and the second sheet is perpendicularly arranged between the first sheet and the third sheet, the first sheet comprises a plurality of negative elements for connecting to ground to discharge static electricity; and wherein the support shelf comprises a ring-shaped for fastening the earphone cable to the motherboard, the ring-shaped is formed at a free end of the first sheet.

8. The wearable device according to claim 7, wherein the earphone cable comprises a positive wire and a negative wire, the positive wire and the negative wire are fastened to the motherboard.

9. The wearable device according to claim 8, wherein the motherboard comprises a positive head and a negative head, the positive wire is electrically connected to the positive head, and the negative wire is electrically connected to the negative head.

10. The wearable device according to claim 8, wherein the second sheet comprises a hook, the positive wire and the negative wire pass through the hook to be fastened to the motherboard.

11. The wearable device according to claim 7, wherein the motherboard defines a receiving chamber for receiving a battery, the third sheet covers the receiving chamber, which enables the battery fixedly received in the receiving chamber.

12. The wearable device according to claim 7, wherein the first sheet defines a through hole, the motherboard defines a screw hole corresponding to the through hole, the support shelf is fastened to the motherboard when a screw passes through the through hole and is received in the screw hole.

* * * * *